United States Patent [19]

King

[11] Patent Number: 5,044,187

[45] Date of Patent: Sep. 3, 1991

[54] METAL TUBING ROLLER OR CROWNER

[76] Inventor: Willaim E. King, 6758 S. Heggenes Rd., Clinton, Wash. 98236

[21] Appl. No.: 546,705

[22] Filed: Jun. 29, 1990

Related U.S. Application Data

[63] Continuation of Ser. No. 256,176, Oct. 11, 1988, abandoned, which is a continuation-in-part of Ser. No. 114,706, Oct. 30, 1987, abandoned.

[51] Int. Cl.[5] ..... B21D 3/04

[52] U.S. Cl. ..... 72/175; 72/248

[58] Field of Search ..... 72/173-175, 72/164, 215-219, 158, 248, 462

[56] References Cited

U.S. PATENT DOCUMENTS

| | | | |
|---|---|---|---|
| 536,238 | 3/1895 | Stanford | 72/175 |
| 962,831 | 6/1910 | Haga | 72/164 |
| 1,034,059 | 7/1912 | Beeman | 72/175 |
| 1,413,527 | 4/1922 | Drummond | 72/175 |
| 1,707,991 | 4/1929 | Oskamp | 72/175 |
| 2,095,474 | 10/1937 | Kinder | 72/164 |
| 2,355,448 | 8/1944 | Kratz | 72/164 |
| 3,420,080 | 1/1969 | Supina et al. | 72/175 |
| 3,704,616 | 12/1972 | Taira | 72/175 |

FOREIGN PATENT DOCUMENTS

| | | | |
|---|---|---|---|
| 978974 | 12/1982 | U.S.S.R. | 72/217 |
| 441313 | 1/1936 | United Kingdom | 72/164 |
| 568142 | 3/1945 | United Kingdom | 72/174 |

*Primary Examiner*—Daniel C. Crane

*Attorney, Agent, or Firm*—Harry M. Cross, Jr.

[57] ABSTRACT

A metal tubing rolling apparatus positions a metal tubing section between three Nylon rollers for bending into a desired curvature. The middle roller is adjustably mounted to be raised and lowered and to preset the degree of arc to be placed in the portion of the tubing section between the fixed rollers. A constraining mounting for the middle roller permits vertical travel of the middle roller while maintaining a coplanar relationship with the fixed rollers.

4 Claims, 1 Drawing Sheet

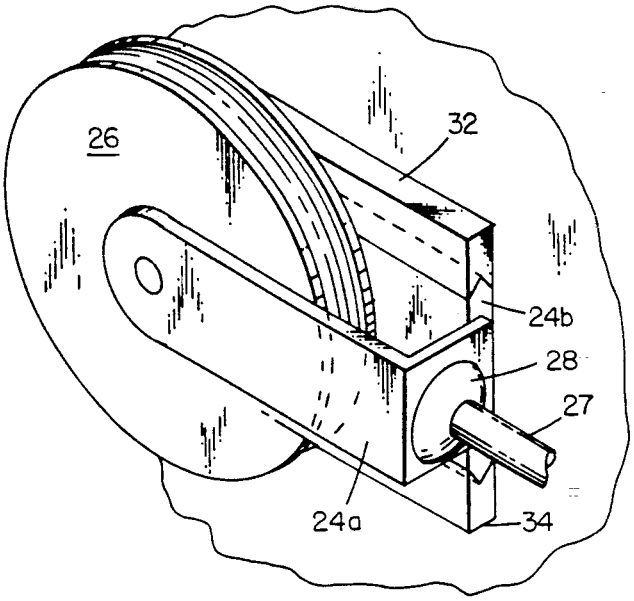
FIG. 4
FIG. 3
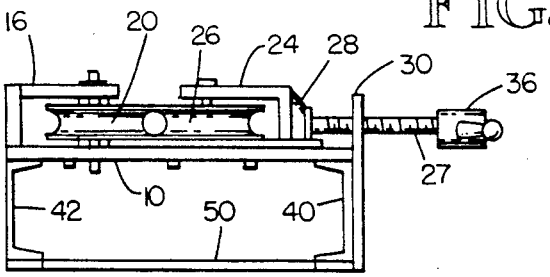
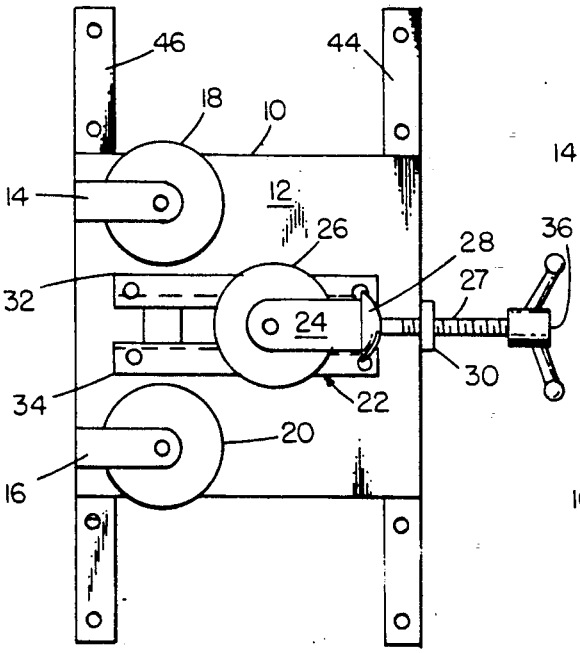
FIG. 1
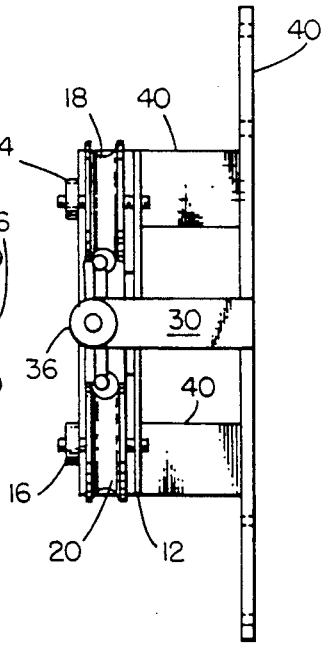
FIG. 2

METAL TUBING ROLLER OR CROWNER

This application is a continuation of application Ser. No. 07/256,176 filed Oct. 11, 1988, now abandoned, which was a continuation-in-part of application Ser. No. 07/114,706 filed Oct. 30,1987, now abandoned.

FIELD OF THE INVENTION

This invention pertains to devices for bending metal tubing and specifically to such devices for bending metal tubing for use in a marine environment.

Metal tubing, either stainless steel or aluminum, is formed by rolling and bending into various shapes for use on boat tops, hand rails, and the like. Smaller boats such as pleasure craft often have canvas tops supported by metal tubing frames. Frequently, these frames are adjustable so that the top is convertible. The metal tubing frames for such tops must be formed carefully so that the convertible mechanism will work smoothly when the top is raised and lowered. Moreover, in convertible top manufacturing, the metal tubing must be consistently formed from one set to another so that the tubing sets will fit the manufactured fabric tops.

Heretofore, manufacturers of boat convertible tops have formed their tubing frames by means that did not produce consistent results. The arcs through which frame sections were bent to provide a crown in the overhead segment could not be uniformly maintained without time consuming effort and attention to detail.

SUMMARY OF THE INVENTION

A primary object of the present invention is to provide a manually-operated tubing roller that can easily and conveniently bend tubing by rolling it to provide a gradual curve or bend of uniform arc. Another object is to provide such a device that can be wall-mounted. A further object is to provide such a device that is simple to assemble and maintain, and yet sturdy for years of trouble-free operation.

The tubing roller of this invention comprises a three rollers in series, the outer two of which are fixed and the middle one of which is adjustably mounted. The middle roller is mounted on a track such that it may be positioned toward or away from the position of the outer rollers to control the degree of bending that occurs as a metal tube is drawn through the device.

BRIEF DESCRIPTION OF THE DRAWINGS

FIG. 1 is a front elevation view of the tube roller of this invention;

FIG. 2 is a top view of the roller of FIG. 1;

FIG. 3 is a side elevation view of the roller of FIG. 1; and

FIG. 4 is a detailed view illustrating a preferred middle roller mounted slide.

DETAILED DESCRIPTION OF THE INVENTION

The components of the metal tubing roller of this invention are mounted on a rectangular steel plate 10. A pair of roller-mounting brackets 14 and 16 are mounted to the formica side of plate 10, one at each lower corner as shown. Rollers 18 and 20 are journal mounted in a respective roller bracket for rotation in the same plane with their axis of rotation aligned. The adjustable middle roller assembly 22 is mounted in the middle of plate 10.

A U-shaped bracket 24 mounts the middle roller 26 in a journal mounting for rotation in the same plane as rollers 18 and 20. Bracket 24 is connected to an adjustment screw 27 by means of mounting element 28 welded to the top of bracket 24. Adjustment screw 26 is threaded through a flat steel bar 30 mounted at the top of plate 10, bar 30 extending outward a sufficient distance to position middle roller 26 in line with rollers 18 and 20. The bracket 24 has vertical legs fabricated of rectangular steel plate stock. The in-board leg of bracket 24 is fabricated with a thickness and width that will permit it to slidably fit within and under the edges of a pair of vertical steel bar guides 32 and 34. These guide members 32–34 are spaced apart as shown and their adjacent edges are undercut to provide rectangular guideways within which the bracket in-board leg fits for sliding movement up and down. These bar guide members are fastened to the mounting plate 10. A turning handle member 36 is attached to the top of the adjustment screw 27. As screw 27 is turned, the roller-mounting bracket 24 will be raised or lowered, depending on the direction of turning. With bracket 24 being constrained by the bar guides 32–34, roller 26 is maintained in alignment with the fixed rollers 18 and 20, even when in contact with a piece of tubing.

Alternately and preferably, the guide members 32–34 are provided with opposing v-grooved edges along their adjacent edges as shown in FIG. 4. The inboard leg **24*b* of the middle roller mounting bracket 24 is provided with vertical knife edges, each having an included angle matching the included angle of the guide member v-grooved vertical edges. The adjacent edges of the guide members and the inboard bracket interfit as shown. Consequently, the inboard leg 24*b* is confined by and rides in the guide member grooves, all as shown in FIG. 4. This is a preferable arrangement, inasmuch as the lateral positioning of the bracket 24** is more definite and there is less friction to overcome as the bracket is shifted upward or downward.

The three rollers are provided with grooved peripheries, the grooves being semicircular in cross section as shown in FIGS. 2 and 3. During a tube bending operation, the middle roller 26 would be retracted upward to enable a tubing section to be place on the end rollers 18 and 20. The middle roller is then screwed downward into contact with the tubing section, and further until the desired arc of curvature is put into the portion of the tubing section between the rollers 18 and 20. The operator then grasps the tubing section and pulls it through the roller assembly until the desired curvature is put into the tubing section. A curvature may be placed in the entire tubing section or only a portion of the tubing section. Also, because the middle roller position is adjustable, a compound curvature may be placed in the tubing section, if desired. The rollers 18, 20 and 26 are made of No. 101 Nylon. The tubing is only contracted by Nylon members and therefore will not be marred by the bending operation. Moreover, if any metal burrs get on the bender, they will not be readily transferred to the tubing. The Nylon is self-lubricating and the tubing will not be scratched by the bendign operation.

Mounting plate 10 is reinforced by upper and lower horizontal steel channel webs 40 and 42. These webs are welded to the back of mounting plate 10 and are in turn welded to upper and lower steel attachment bars 44 and 46, respectively. The metal bars are provided with bolt holes for attachment to a wall. These holes are spaced to permit attachment to wall studs spaced at 16 inch and 24 inch on-center-intervals to facillitate fastening to studs by means of lag screws, if needed. Multiple reinforcing straps 50 are welded to the facing back edges of the channels 40–42 and the upper and lower mountin bars 44–46 to stiffen the assembly. The reinforcing tubes 40 and 42 also serve to space to device out from a wall to which it is attached. Therefore, the tube bending elements of the device are spaced outward a sufficient distance to facillitate insertion and removal of a tubing section.

While a preferred embodiment of the tubing roller of this invention has been described, certain changes may be made without departing from the scope of the invention. Consequently, the scope of the invention is only to be delimited by the appended claims herein.

What is claimed is:

1. A metal tube rolling apparatus comprising a mounting plate having a means for securing said mounting plate to a wall so that said planar face extends vertically;

a pair of rollers journal mounted in fixed positions to said planar face of said mounting plate and extending outward therefrom with horizontal axes of rotation perpendicular to said face when said mounting plate is arranged in a vertical operation position; a middle roller adjustably mounted to said mounting plate for movement transversely to a line between the two fixed rollers; and the rollers are arranged on the planar face to engage the metal tube during rolling so that the two fixed rollers are on side of the tube and the adjustable roller is on the opposite side of the tube with the fixed rollers being offset from the adjustable roller;

and middle roller mounting means journal mounting said adjustable roller for rotation about a horizontal axis perpendicular to said face when said mounting plate is arranged in a vertical operating position; said middle roller mounting means including an inverted downwardly-opening U-shaped roller-mounting bracket having inner and outer legs connected at the top with the middle roller rotatably-mounted between the two legs, the inner leg of which is slidably constrained in a pair of guide bars mounted to the face of said mounting plate to maintain said adjustable roller in a coplanar relationship with the two fixed rollers during operation, middle roller adjustment means positioned above said roller mounting bracket and contacting said mounting bracket centrally above said middle roller whereby downward force exerted by said adjustment means will be directed centrally of said mounting bracket;

and said pair of guide bars fastened to the face of said mounting plate with one guide bar having a vertical edge parallel to and opposed by a corresponding vertical edge of the other guide bar edge, the opposing guide bar edges each having a V-shaped groove provided therein extending the length of the guide bar, each V-shaped groove extending along its respective guide bar edge being defined by a pair of flat intersecting surfaces, each flat intersecting surface of each V-shaped groove oriented at an angle to the planar face of the mounting plate; and the constrained leg of said middle roller mounting bracket having V-shaped vertical edges provided therein and interfitted with said pair of flat intersecting surfaces of each guide bar V-shaped groove whereby said mounting bracket is solely confined between and by said guide bars and tracks within said guide bar grooves whereby said middle roller mounting bracket may be moved parallel to said mounting plate face without interference from contact with said face and with less friction and better lateral positioning.

2. The rolling apparatus according to claim 1 wherein said mounting plate is provided with upper and lower reinforcing channels secured to the backside thereof, the upper channel extending across the upper portion of said backside and the lower channel extending across the lower portion of said backside, and wherein attachment bars are secured to said reinforcing channels for attachment of said bending apparatus to a wall, whereby the forming elements of said apparatus will stand out from a wall to facilitate inserting and removing a tubing section from said apparatus.

3. The rolling apparatus according to claim 2 wherein said mounting plate is faced with a low-friction, non-metallic material to protect a tubing section from abrasion and to facillitate movement of said forming arm during a bending operation.

4. The rolling apparatus according to claim 1 wherein said middle roller mounting means includes a handle-operated screw positioned outward from said mounting plate and attached to the top of said middle roller-mounting bracket for vertical adjustment of said middle roller.

* * * * *